United States Patent [19]

Jokisch

[11] Patent Number: 4,486,269

[45] Date of Patent: Dec. 4, 1984

[54] METHOD OF DRY COOLING COKE

[75] Inventor: Friedrich Jokisch, Essen, Fed. Rep. of Germany

[73] Assignee: Krupp-Koppers GmbH, Essen, Fed. Rep. of Germany

[21] Appl. No.: 424,965

[22] Filed: Sep. 27, 1982

Related U.S. Application Data

[63] Continuation-in-part of Ser. No. 203,666, Nov. 3, 1980, abandoned.

[30] Foreign Application Priority Data

Jan. 29, 1980 [DE] Fed. Rep. of Germany ..... 3002990

[51] Int. Cl.[3] ..... C10B 39/02; C10B 45/00

[52] U.S. Cl. ..... 201/1; 201/39; 202/228

[58] Field of Search ..... 203/666; 201/39, 1; 202/228; 34/10, 33

[56] References Cited

U.S. PATENT DOCUMENTS 4,211,607 7/1980 Privalov et al. ..... 202/228

FOREIGN PATENT DOCUMENTS 2432025 1/1976 Fed. Rep. of Germany ..... 202/228

698891 2/1931 France ..... 202/228

*Primary Examiner*—Bradley Garris

*Attorney, Agent, or Firm*—Michael J. Striker

[57] ABSTRACT

Cooling of a gas-permeable loose material having highly temperature-dependent coefficient of thermal conductivity is performed in a shaft-shaped chamber with use of a gaseous cooling medium so that the loose material is fed from above downwardly in a counter stream against a stream of the gaseous medium supplied from below upwardly. The stream of the gaseous medium is subdivided into two partial streams, and one of the partial streams is supplied into the lower part of the chamber, whereas the other of the partial streams is supplied into a region in which the loose material has at least a temperature above which the coefficient of thermal conductivity of the loose material in dependence upon the temperature greatly increases.

5 Claims, 3 Drawing Figures

METHOD OF DRY COOLING COKE

CROSS-REFERENCE TO A RELATED APPLICATION

This application is a continuation-in-part of application Ser. No. 203,666 filed Nov. 3, 1980, now abandoned.

BACKGROUND OF THE INVENTION

The present invention relates to a method of cooling gas-permeable materials having highly temperature-dependent coefficient of thermal conductivity. More particularly, it relates to a method of cooling such materials in a shaft-shaped chamber wherein a loose material is fed in counter stream to a gaseous cooling medium supplied from below downwardly and wherein the stream of the cooling medium is subdivided into two partial streams.

Methods of cooling of the above-mentioned general type are known in the art. In a known method, a loose material which travels from above downwardly in a shaft-shaped chamber in a counter stream to a gaseous cooling medium, advantageously air or inert gas, is pierced by the cooling medium. The cooled cooling medium is normally directed into the lower part of the chamber and the heated cooling medium is withdrawn from the upper part of the chamber. Subsequently, the heated cooling medium can in some cases be cooled, with heat recovery by supplying the same into a heat exchanger, waste-heat boiler, or another cooling device. After this, the cooling medium can be returned into the process by supplying into the lower part of the shaft-shaped chamber.

At present the above-described process, particularly for so-called dry coke cooling, became very important. This development is based upon the consideration that the previously known conventional methods of coke cooling which involve quenching the glowing coke with water in special quenching towers, is extremely unfavorable in the sense of the energy utilization or energy recovery as well as the environment protection. In the conventional water quenching method, the heat which is withdrawn with the quenching water escapes into the surrounding atmosphere without being used. For example, heat is carried away in the form of vapor clouds in the air and/or with the flowing off quenching water. In contrast, when loose materials are cooled by gaseous cooling medium, as described above, a greater part of heat of the glowing coke can be recovered from the cooling medium in a waste-heat boiler or the like. The so-called dry coke cooling is a preferable application area of the present invention which is, however, not limited to the same. It has been recognized however, that the downward movement of the coke to be cooled in the shaft-shaped chamber is characterized by different speeds. Similarly, the gas stream through the cross-section of the chamber is also non-uniform in many cases. Both these phenomena can naturally cause a non-uniform cooling of the coke, and the cooling is performed slower, particularly in the upper part of the chamber.

The German Auslegeschrift No. 2,432,025 describes an arrangement for dry quenching of coke, in which the gaseous cooling medium is supplied in two partial streams into the cooling chamber. One of the partial streams is directed to the bottom of the chamber and particularly to a compact layer located in this region.

The second partial stream is supplied through a so-called stream divider into the interior of the chamber and there exits in the region of the central axis to the compact layer. The above-mentioned German reference does not contain any data about special functions and operation to be performed by the second partial stream of the cooling medium or the manner of dividing the partial streams. The arrangement disclosed in this reference pursues the only purpose to provide of a best possible uniform movement of the material to be treated with a best possible uniform division of the cooling medium.

SUMMARY OF THE INVENTION

Accordingly, it is an object of the present invention to provide a method of cooling gas permeable loose materials, which avoids the disadvantages of the prior art.

More particularly, it is an object of the present invention to provide a method of cooling gas permeable loose materials with the use of a gaseous cooling medium, which provides for optimum conditions of the cooling process.

It is particularly an object of the present invention to reduce pressure losses of the gaseous cooling medium in the chamber, to influence favorably the temperature differential between the gaseous cooling medium and loose material to be treated, and to improve controllability both in the sense of the quantity of the gaseous cooling medium, and in the sense of heat transmission from the material to be cooled.

In keeping with these objects and with others which will become apparent hereinafter, one feature of the present invention resides, briefly stated, in a method of cooling in which a gas permeable loose material having highly temperature-dependent coefficient of thermal conductivity is fed in a shaft-shaped chamber from above downwardly, and a gaseous cooling medium is supplied in this chamber from below upwardly in a stream formed by two partial streams, wherein one of the partial streams is directed in conventional manner into the lower part of the chamber whereas the other partial stream is directed, in accordance with the invention, in a region of the chamber, in which the loose material has at least a temperature ($\vartheta_G$) above which the coefficient of thermal conductivity ($\lambda$) of the loose material in dependence upon the temperature greatly increases.

In accordance with further features of the invention the first and the second streams are introduced into the chamber in respective quantities which are adjustable, said first stream and the second stream being withdrawn from said chamber through a common outlet conduit.

Furthermore, those quantities may be distributed over the one stream and the second stream introduced into the chamber, by means of a temperature feeler mounted in said common outlet conduit such that the temperature of the gaseous cooling medium withdrawn from said chamber is maintained constant.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

In accordance with the invention a gas-permeable loose material which has highly temperature-dependent coefficient of thermal conductivity is fed in a shaft-shaped chamber from above downwardly. A gaseous cooling medium is supplied in the chamber from below upwardly, whereby the loose material travels in a counter stream to a stream of the gaseous medium. The stream of the gaseous medium is subdivided into two partial streams. One of the partial streams is directed into the lower part of the chamber. As for the other of the partial streams, it is directed in a region of a chamber in which the loose material has at least a temperature ($\vartheta_G$) above which the coefficient of thermal conductivity ($\lambda$) of the loose material in dependence upon the temperature greatly increases.

Figure 1:
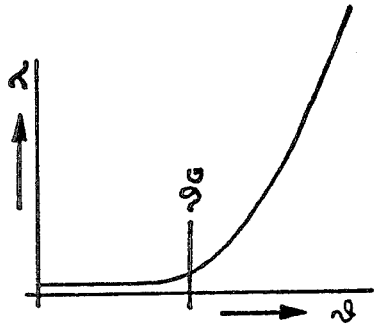
FIG. 1 is a view illustrating the dependence between the temperature ($\vartheta_G$) and the thermal conductivity ($\lambda$) of a loose material.

The inventive method proceeds from the assumption that certain solid material, to which the coke also pertains, has the coefficient of thermal conductivity ($\lambda$) which is highly dependent upon the temperature. FIG. 1 shows a coordinate system in which the abscissa represents the temperature ($\vartheta$) and the ordinate represents the thermal conductivity ($\lambda$). The curve of typical form is shown in this coordinate system and clearly illustrates that in the beginning the thermal conductivity ($\lambda$) does not increase or increases very slowly with the increase of temperature. When predetermined limit temperature ($\vartheta_G$), which of course depends on the material, is attained or exceeded, the thermal conductivity shows a relatively sharp increase.

On the other hand, the progress in time of the convective total heat transmission between the solid material and the gaseous cooling medium is determined by the heat conduction resistance in the solid material itself and by the heat transmission resistance between the solid material and the gaseous cooling medium. The heat conduction resistance is equal to $S/\lambda$ and depends upon a particular material, inasmuch as S indicates the characteristic thickness of the solid material body concerned and its coefficient of thermal conductivity.

The heat conduction resistance is influenced only by the geometrical shape of the solid material body. The heat transmission resistance is thereby defined as $1/\alpha$, wherein the heat transmission coefficient $\alpha$ describes the heat exchange between the gaseous cooling medium and the surface of the solid material. The heat transmission coefficient is dependent upon the flow of the solid material body, that is upon its geometrical shape and flow speed of the gaseous cooling medium.

In view of the above described temperature dependence of the coefficient of thermal conductivity ($\lambda$) it can be seen that in the region below the limit temperature ($\vartheta_G$) the following relation applies:

$$S/\lambda > 1/\alpha.$$

As for the region above the limit temperature ($\vartheta_G$) the following relation applies:

$$S/\lambda > 1/\alpha.$$

For the practice this means that in the lower part of the shaft-shaped chamber there is a lower coefficient of thermal conductivity ($\alpha$) because of the stronger cooling of the loose material therein. Thereby, the lower part of the chamber is characterized by a higher heat transmission resistance ($S/\lambda$) which determines the total heat transmission. Therefore, it is not advisable to introduce the entire quantity of the gaseous cooling medium into the lower part of the shaft-shaped chamber because this will not result in attainment of the cooling effect corresponding to the quantity of the cooling medium. It suffices when only a partial stream of the gaseous cooling medium is introduced into the lower part of the chamber, the partial stream being sufficient to carry away the heat in this region. It is much better for the cooling effect when the second partial stream of the gaseous cooling medium is introduced into the shaft-shaped chamber in the region of its upper part where the loose material to be cooled has only such a temperature which does not lie below the so-called limit temperature ($\vartheta_G$) wherefore the heat conduction resistance ($S/\lambda$) is then correspondingly small.

It has been proved advantageous when, in accordance with the present invention, the second partial stream carries between 20% and 50% in volume of the total required quantity of the cooling medium. This object can be additionally attained in such a manner that in the region of the feeding point of the second partial stream of the cooling medium, the flow speed of the media is increased by a corresponding reduction of the flow passage, which results in a decrease of the heat transmission resistance ($1/\alpha$). As for the construction of the above-mentioned passage reduction, it can be attained either by the corresponding narrowing in the upper part of the shaft-shaped chamber, or by installation of a corresponding structure in the upper part of the chamber.

In accordance with the inventive method of dry cooling of coke, the second partial stream of the gaseous cooling medium must be fed into a region of the chamber, in which the coke to be cooled has a temperature of approximately between 400° C. and 600° C.

Figure 2:
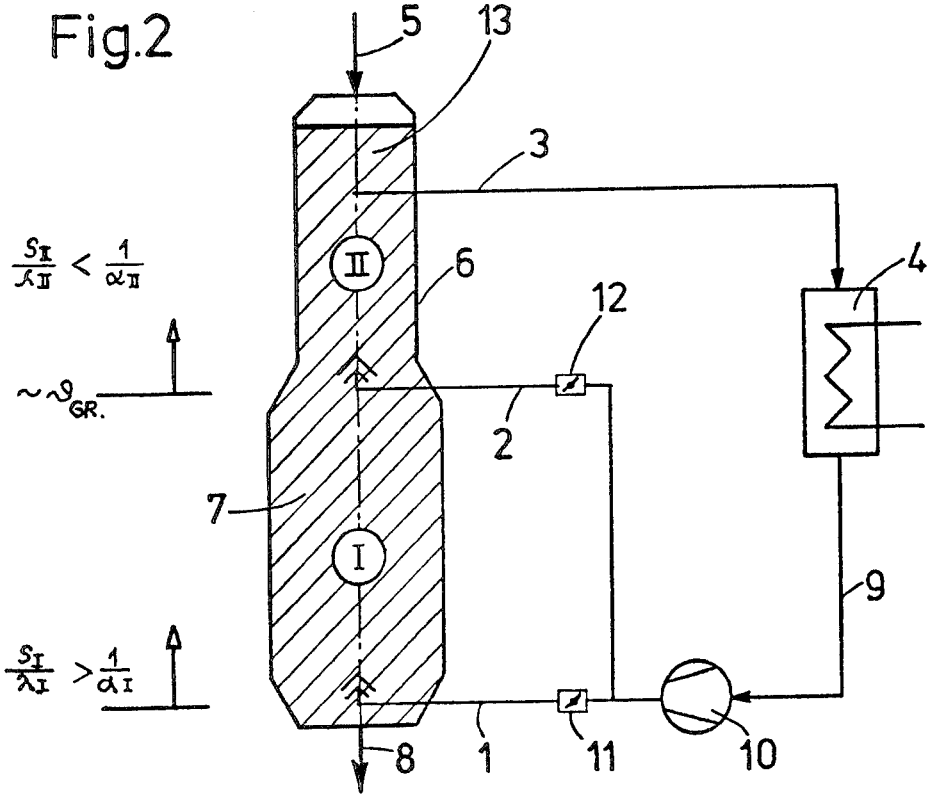
FIG. 2 is a schematic view of a device for implementation of the method in accordance with the present invention.

An example of the process in accordance with the present invention is illustrated by a flow diagram shown in FIG. 2. The glowing or red-hot coke is introduced in the form of a charge 5 with a temperature of about 1,100° C. in a quantity of approximately 80 t/h from above into a shaft-shaped chamber 6. It travels first in the upper part of the chamber 6 which is located above a conduit 3 and forms so-called pre-chamber 13. In the pre-chamber 13, vibrations which are caused by the supply of the glowing coke must be adjusted and silenced. Thereby, guasi-stationary condition is insured in the lower region of the chamber 6. The entire chamber 6 is provided with a suitable refractory coating. The chamber 6 in its upper region II has a reduced cross-section so that the flow speed of the media in this region is increased as compared with the lower region I.

The fed coke forms in the chamber 6 a compact layer 7 which is identified by hatching in the drawing. The temperature inside the compact layer gradually decreases from above downwardly so that the cooled coke in the desired quantity can be withdrawn from an outlet 8 with a temperature of approximately 180° C.

The gaseous cooling medium in accordance with the invention is introduced into the chamber in two partial streams. The first partial stream enters the lower part of the chamber 6 through a conduit 1. Simultaneously, the second partial stream of the same cooling medium with a quantity of between 30–35 volume % of the entire quantity, is introduced through a conduit 2 in another region of the chamber 6, particularly in the region where the compact layer 7 has a temperature of approximately 500° C. The inventive condition with respect to the limit temperature ($\vartheta_G$) of the coefficient of thermal conductivity ($\lambda$) is satisfied with this temperature value.

The heat conduction resistance of the compact layer 7 in the region above the feeding point of the second partial stream of the gaseous cooling medium is smaller than the heat transmission resistance of the same. In the region below the heating point this relation is exactly opposite. This is illustrated by the formulas shown in FIG. 2.

The heated gaseous cooling medium is withdrawn through the conduit 3 from the upper part of the chamber 6 and travels into a waste-heat boiler 4. The heated gaseous cooling medium admitted into the boiler 4 is cooled with simultaneous heat recovery. Thereafter the cooled gaseous cooling medium can be returned through a conduit 9 and an impeller 10 into the cycle to the conduit 1.

The conduit 2 branches from the conduit 1.

Control valves 11 and 12 serve for the required control of both partial streams. An impeller can also be utilized, instead of the control valves 11 and 12, for controlling both partial streams. Similarly, other possibilities of heat recovery, instead of the heat recovery in the waste-heat boiler, can be utilized. The recovered energy can be again used, for example, for pre-heating of the coking coal or as process heat.

Inert gas, for example, flue gas can be utilized as the gaseous cooling medium. As can be seen from FIG. 2, the narrow portion of the chamber 6 which increases the flow speed in the upper part, begins in the region of the inlet point of the conduit 2 in the chamber 6. This is provided here as a purely optional feature which is not necessary in each case. The chamber of the same diameter over the entire length thereof is shown in FIG. 3.

Figure 3:
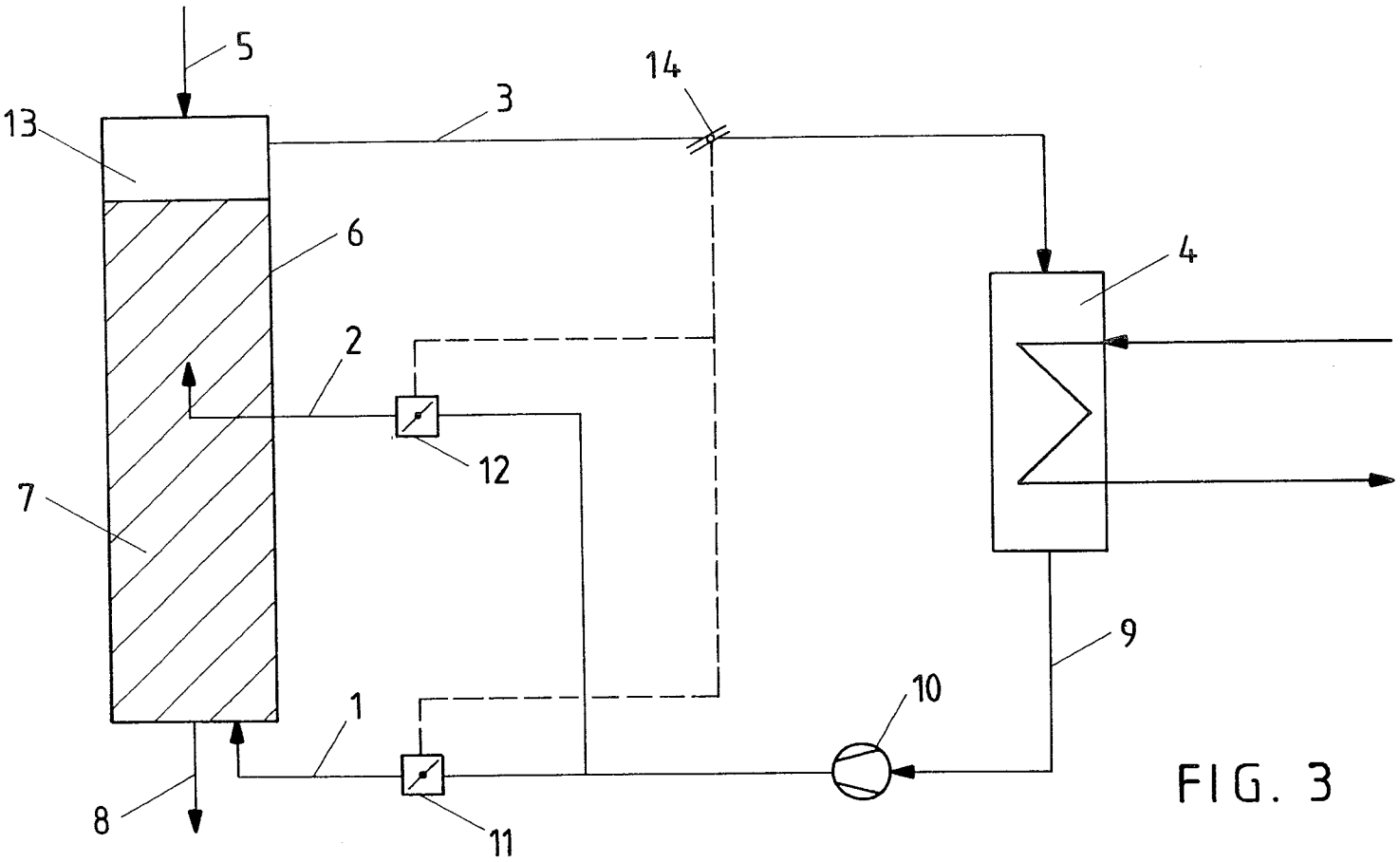
FIG. 3 is a schematic view of a device with a temperature feeler installed in an outlet conduit.

With further reference to FIG. 3 it can be seen that a temperature feeler 14 is inserted in the conduit 3 and is connected, respectively to valves 11 and 12. The distribution of quantities of cooling gas between the stream flowing through conduit 1 and the stream passing through conduit 2 is controlled by valves 11 and 12 in response to the temperature fluctuations sensed by the temperature feeler 14 in such a fashion that the outlet temperature of the cooling gas medium leaving chamber 6 through the conduit 3 is maintained constant.

When the method is performed in accordance with the applicant's invention the following advantages are attained:

The pressure loss for the passage of the chamber is reduced, inasmuch as the gas stream is subdivided and thereby the entire gas quantity must not be pressed through the entire loose material. As a result of this a reduced energy consumption for the impeller is required. The temperature differential between the gas and solid material is favorably influenced. The subdivision into partial streams improves controllability of the gas quantity and thereby an improved controllability of the heat withdrawal from the compact layer is attained.

It will be understood that each of the elements described above, or two or more together, may also find a useful application in other types of constructions differing from the types described above.

While the invention has been illustrated and described as embodied in a method of cooling of gas-permeable loose materials having highly temperature-dependent coefficient of thermal conductivity with the use of a cooling medium, it is not intended to be limited to the details shown, since various modifications and structural changes may be made without departing in any form from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed as new and desired to be protected by Letters Patent is set forth in the appended claims.

I claim:

1. A method of dry cooling a gas-permeable loose coke with highly temperature dependent coefficient of thermal conductivity in a shaft-shaped chamber having an upper part and a lower part, comprising the steps of feeding a gas-permeable loose coke with highly temperature dependent coefficient of thermal conductivity in a shaft-shaped chamber from above downwardly; and supplying a gaseous cooling medium into said chamber so that the gaseous cooling medium flows from below in upward direction in counterstream to the coke to cool the latter, said gaseous cooling medium being subdivided into two separate streams which are introduced into said chamber simultaneously, one of said streams being introduced into the lower part of said chamber and the other of said streams being introduced into said chamber only in the region thereof in which the coke has at least a temperature ($\vartheta_G$) above which the coefficient of thermal conductivity ($\lambda$) of the coke in dependence upon the temperature greatly increases, said supplying step including supplying the gaseous cooling medium in a predetermined quantity, said steps of subdividing the gaseous cooling medium and introducing said other stream including performing the same so that the other stream carries substantially between 20% and 50% in volume of the total quantity of the gaseous cooling medium supplied into said chamber, said step of introducing the other stream including admitting the same into the region of the chamber, wherein the coke to be cooled has a temperature of approximately between 400° C. and 600° C.

2. The method as defined in claim 1, wherein said step of introducing said other stream includes admitting the same into a region of the chamber, wherein the speeds of the coke to be cooled and of the gaseous medium are increased.

3. The method as defined in claim 2, wherein said admitting step includes performing the same so that the other stream of the gaseous cooling medium has a feeding point in a narrowed part of the chamber, forming said region wherein said speeds are increased.

4. The method as defined in claim 1, wherein said one stream and the other stream are introduced into said chamber in respective quantities which are adjustable, said one stream and the other stream being withdrawn from said chamber through a common outlet conduit.

5. The method as defined in claim 4, wherein said respective quantities are distributed between said one stream and the other stream introduced into said chamber by means of a temperature feeler mounted in said common outlet conduit such that the temperature of the gaseous cooling medium withdrawn from said chamber is maintained constant.

* * * * *